US005580179A

United States Patent [19]

Abe et al.

[11] Patent Number: 5,580,179

[45] Date of Patent: Dec. 3, 1996

[54] PRINTER WITH RIBBON MASK OPENING MECHANISM

[75] Inventors: Shuichi Abe; Satoru Tsuri; Shunji Yamaguchi, all of Kawasaki, Japan

[73] Assignee: Fujitsu Limited, Kanagawa, Japan

[21] Appl. No.: 407,370

[22] Filed: Mar. 20, 1995

[30] Foreign Application Priority Data

May 24, 1994 [JP] Japan ..... 6-110070
May 24, 1994 [JP] Japan ..... 6-110071

[51] Int. Cl.[6] ..... B41J 35/03

[52] U.S. Cl. ..... 400/248; 400/248.1

[58] Field of Search ..... 400/248, 248.1, 400/248.2, 248.3

[56] References Cited

FOREIGN PATENT DOCUMENTS 59-35967 2/1984 Japan ..... 400/248.2
60-242089 12/1985 Japan ..... 400/248.1
61-61880 3/1986 Japan ..... 400/248.1
1-171879 7/1989 Japan ..... 400/248.1
4-53786 2/1992 Japan ..... 400/248.1

*Primary Examiner*—John S. Hilten
*Attorney, Agent, or Firm*—Nikaido Marmelstein Murray & Oram LLP

[57] ABSTRACT

A printer having ribbon mask opening mechanism is provided with a carriage, a print head, and a printing ribbon. The printer includes a ribbon mask pivotable about a shaft parallel to a feeding direction of the printing ribbon between a closed condition and an open condition of the ribbon mask, a device for biasing the ribbon mask in its closing direction, and a mechanism for opening the ribbon mask against a biasing force of the biasing device. The ribbon mask opening mechanism in the printer allows an operator to smoothly replace the printing ribbon and also allows the operator to easily set the printing ribbon in a proper position.

14 Claims, 14 Drawing Sheets

PRINTER WITH RIBBON MASK OPENING MECHANISM

BACKGROUND OF THE INVENTION

1. Field of the Invention

The present invention relates generally to a printer such as a bankbook printing machine for use in a financial institution, and more particularly to a ribbon mask opening mechanism for allowing an operator to simply and quickly replace a printing ribbon and also to a deflector mechanism for preventing the jam of a deformed recording medium.

2. Description of the Prior Art

In a financial institution such as a bank, there has been widely used in recent years a printing machine for printing necessary data such as unentered data on a printing medium such as a bankbook or a voucher inserted into the machine. The restoration from trouble such as jamming or the replacement of an ink ribbon in the printing machine is performed by a bank teller. Accordingly, it is required to simplify the replacement of the ink ribbon so that the ribbon can be simply replaced even by an unaccustomed teller. A ribbon mask for guiding and holding the ribbon is mounted under a printing portion formed at the lower end of a print head. A narrow gap defined between the print head and the ribbon mask hinders smooth replacement of the ribbon. Therefore, it is required to largely open the ribbon mask in replacing the ribbon.

A conventional printer generally used includes a carriage slidably supported to a shaft and horizontally movable along the shaft, a print head mounted on the carriage, a printing ribbon guided along a printing portion of the print head, and a ribbon mask for guiding and holding the printing ribbon. Further, a known opening mechanism for the ribbon mask is designed to downward incline the ribbon mask about a shaft perpendicular to a feeding direction of the ribbon and thereby define a relatively large gap between the printing portion of the print head and the ribbon mask.

With the conventional ribbon mask opening mechanism mentioned above, the replacement of the ribbon is troublesome and requires much time. Further, there is a possibility that the ribbon may not be properly set in the printer.

A recording medium such as a bankbook inserted from an insert opening is fed through a feed path to a printing section, where printing is performed. When the recording medium in its deformed condition is inserted from the insert opening, the feed path that is not always flat is sometimes jammed with the recording medium. Accordingly, it is also required to provide a mechanism for preventing the above problem.

In this regard, a known printer includes a printing section having a platen, a front inserter unit provided on the front side of the printing section for feeding a recording medium from an insert opening to the printing section, a rear feed unit provided on the rear side of the printing section for feeding the recording medium fed through the front inserter unit, and a printer unit supported to the rear feed unit so as to be opened and closed with respect thereto and having a print head movable along the platen. This kind of printer sometimes employs a deflector for preventing the jam of the deformed recording medium between the front inserter unit and the printing section or between the printing section and the rear feed unit.

Usually, the deflector is pivotably provided on the rear feed unit so as to pivot in a predetermined angular range (e.g., 90 degrees). Specifically, the deflector is adapted to pivot between a first position where the deflector overlaps an end portion of a movable range of the print head just over the platen and a second position where the deflector is offset from the platen to the rear feed unit.

When the deflector is in the first position, the recording medium can be smoothly moved in a space defined between the deflector and the print head, thereby preventing the deformation of the recording medium. Further, in performing printing with the print head after stopping the recording medium, the deflector in the first position is retracted to the second position, thereby preventing the deflector from interfering with the printing operation of the print head. This kind of conventional deflector mechanism requires a driving source such as a solenoid for driving the deflector and further requires other parts associated with the driving source, thus increasing the number of parts to result in an increase in cost of the printer.

SUMMARY OF THE INVENTION

It is therefore an object of the present invention to provide a printer having a ribbon mask opening mechanism which allows an operator to smoothly replace a printing ribbon and also allows the operator to easily set the printing ribbon in a proper position.

It is another object of the present invention to provide a printer having a deflector mechanism which is simple in structure and fit for a reduction in cost.

According to an aspect of the present invention, there is provided a printer comprising a carriage slidably supported to a first shaft and adapted to reciprocate along the first shaft; a print head mounted on the carriage and having a printing portion; ribbon guiding means for guiding a printing ribbon so that the printing ribbon is slidably held between the ribbon guiding means and the printing portion, the ribbon guiding means having a first position where a small gap is defined between the ribbon guiding means and the printing portion to guide the printing ribbon in printing and a second position where an enough gap is defined between the ribbon guiding means and the printing portion in replacing the printing ribbon; biasing means for biasing the ribbon guiding means from the second position to the first position; a link having a first end and a second end, the first end being connected to the ribbon guiding means; and a lever connected to the second end for displacing the ribbon guiding means from the first position to the second position against a biasing force of the biasing means.

In this printer, when printing is performed, a ribbon mask as the ribbon guiding means is set in the first position where a small gap is defined between the ribbon mask and the printing portion, whereas when the replacement of the printing ribbon is performed, the ribbon mask is set in the second position where an enough gap is defined between the ribbon mask and the printing portion, thereby allowing the operator to smoothly replace the ribbon. Further, the ribbon mask is normally biased by the biasing means from the second position to the first position, and the ribbon mask is displaced by the lever from the first position to the second position against the biasing force of the biasing means. Accordingly, the replacement of the ribbon can be easily carried out and the ribbon can be set in a proper position.

According to another aspect of the present invention, there is provided a printer comprising a printing section having a platen; a front inserter unit provided on a front side of the printing section for feeding a recording medium from an insert opening to the printing section; a rear feed unit provided on a rear side of the printing section for feeding the recording medium fed through the front inserter unit; a printer unit supported to the rear feed unit so as to be opened and closed with respect thereto, the printer unit having a print head movable along the platen; a deflector pivotably mounted on the rear feed unit, the deflector being pivotable between a first position where the deflector overlaps an end portion of a movable range of the print head just over the platen and a second position where the deflector is offset from the platen to the rear feed unit; first biasing means for biasing the deflector from the first position to the second position; and driving means for displacing the deflector from the second position to the first position in association with a closing operation of the printer unit.

In this printer, the deflector is normally biased by the first biasing means from the first position to the second position, and the deflector is displaced by the driving means from the second position to the first position in association with the closing operation of the printer unit. Accordingly, the deflector can be made to perform a required function without the use of a solenoid, electric circuit, etc., thus providing a printer having a deflector mechanism which is simple in structure and fit for a reduction in cost.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
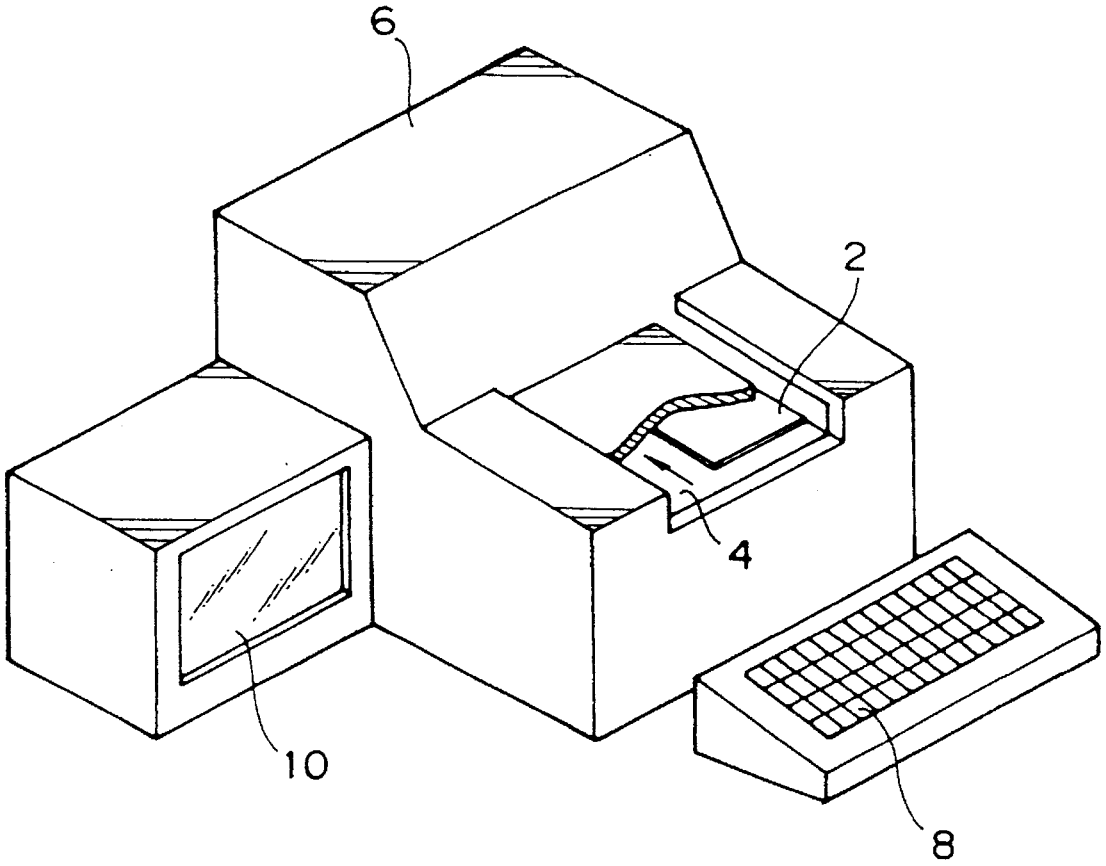
FIG. 1 is a perspective view of a bankbook printing machine to which the present invention is applicable.

FIG. 1 is a perspective view of a bankbook printing machine to which the present invention is applicable. The bankbook printing machine shown in FIG. 1 is provided with a machine body 6 having a bankbook inlet 4 from which a bankbook 2 is horizontally inserted, a keyboard 8 from which a customer's account number, transaction contents, etc. are input, and a display 10 on which the contents of input from the keyboard 8 are displayed. The machine body 6 is connected through a line to a computer center not shown. A bankbook printer to which the present invention is applied is provided in the machine body 6.

Figure 2:
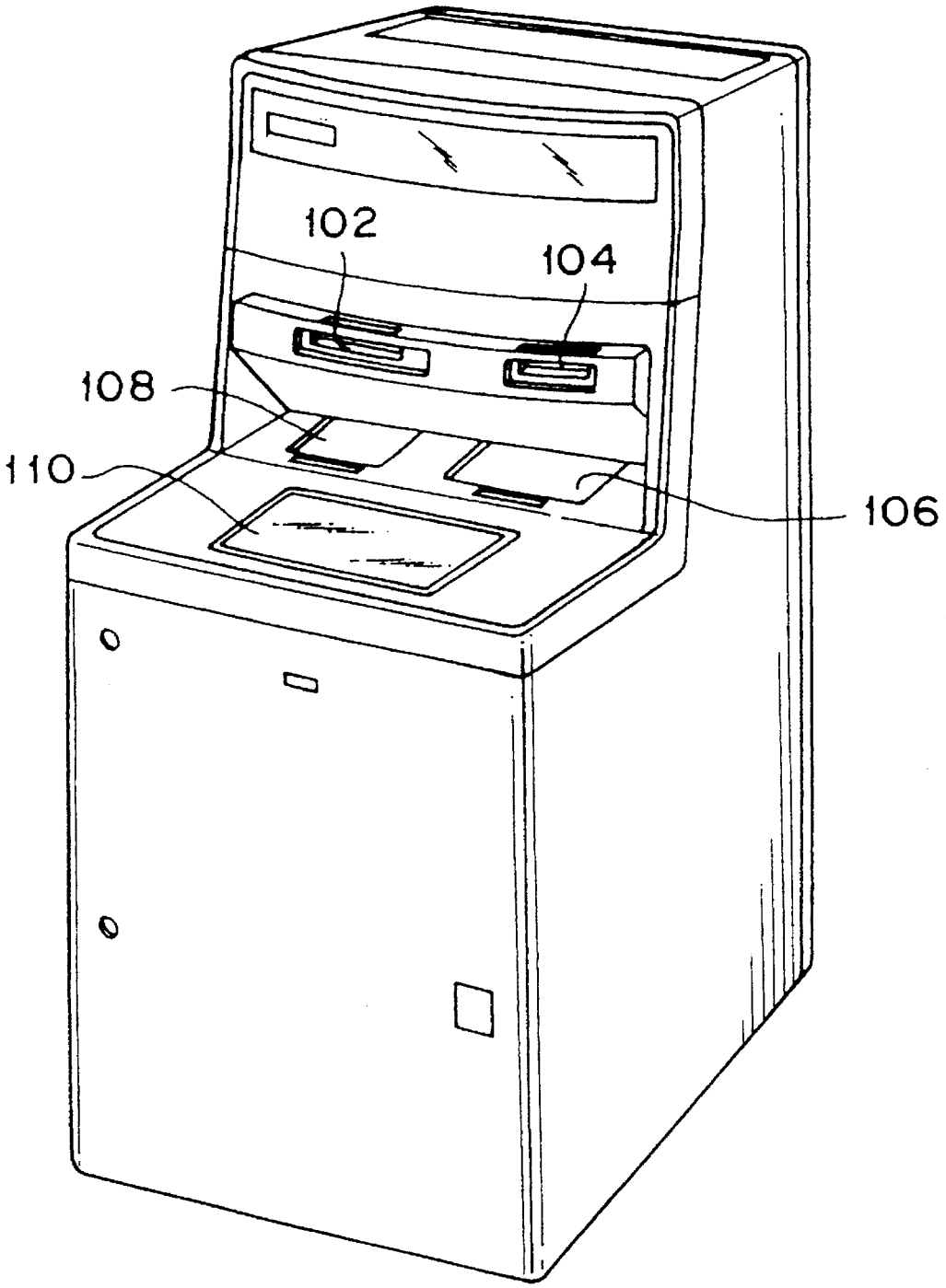
FIG. 2 is a perspective view of an automatic teller machine to which the present invention is applicable.

FIG. 2 is a perspective view of an automatic teller machine to which the present invention is applicable. The automatic teller machine shown in FIG. 2 is provided with a bankbook inlet 102 from which a bankbook is inserted, a card inlet 104 from which a cash card is inserted, a bill inlet/outlet 106 from which a bill is inserted or delivered, a coin inlet/outlet 108 from which a coin is inserted or delivered, and a customer operating portion 110 including a display for displaying a guide when a customer performs transactions and a touch keyboard for inputting information required to perform the transactions. This automatic teller machine allows a customer to perform various transactions including deposit, withdrawal, transfer, entry to the bankbook, and checking of a balance through the customer operating portion 110 without the aid of a teller.

Figure 3:
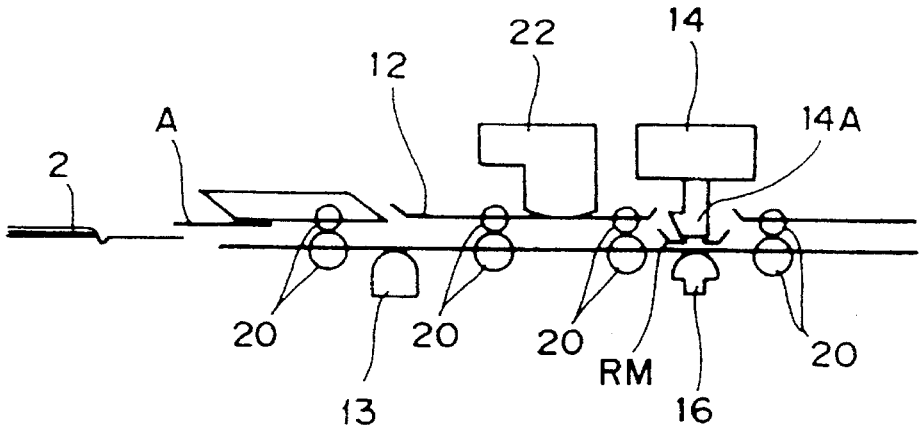
FIG. 3 is a schematic side view of a bankbook printer.

FIG. 3 is a side view of the interior of the bankbook printer. The bankbook printer shown in FIG. 3 includes a feed path 12 for the bankbook 2, a print head 14, a platen 16 opposed to a printing portion 14A formed at an end of the print head 14, a ribbon mask RM interposed between the print head 14 and the platen 16, and a plurality of feed rollers 20. When the bankbook 2 is inserted from the bankbook inlet 4 (see FIG. 1) in a direction of arrow A by a teller, for example, the bankbook 2 is fed in the feed path 12 by the feed rollers 20, and an account number recorded on the bankbook 2 is read by a magnetic stripe reader 13. Thereafter, a page to be printed and a printable line are confirmed by a sensor 22, and the bankbook 2 is then set at a printer section formed between the ribbon mask RM and the platen 16. In this condition, when the keyboard 8 (see FIG. 1) is operated to input an amount of money, etc., the contents of input are displayed on the display 10. Thereafter, when the customer confirms the contents of input displayed and presses a confirmation button, communication between the bankbook printing machine and the computer center is made to print transaction data on the bankbook 2 by the printing portion 14A. After completing the print, the bankbook 2 is ejected from the bankbook inlet 4.

Further, the automatic teller machine is also provided with a bankbook printer similar to that shown in FIG. 3. When a customer needs the entry to a bankbook, the bankbook is inserted from the bankbook inlet by the customer to print on the bankbook any unentered data as a transaction history having not yet been printed on the bankbook. That is, when the presence of the bankbook is selected by operating the customer operating portion in checking a balance or making a deposit or withdrawal, a guide to insert the bankbook from the bankbook inlet is displayed on the customer operating portion. Thereafter, when the customer inserts the bankbook from the bankbook inlet, the bankbook is fed in the feed path by the feed rollers, and an account number or the like recorded on a magnetic stripe of the bankbook is read by the magnetic stripe reader to confirm the validity of the bankbook. Further, a page and a printable line are confirmed by the sensor, and any unentered data transmitted from the computer as well as transaction data at the present time is printed on the bankbook. After completing the print, the bankbook is ejected from the bankbook inlet.

Figure 4:
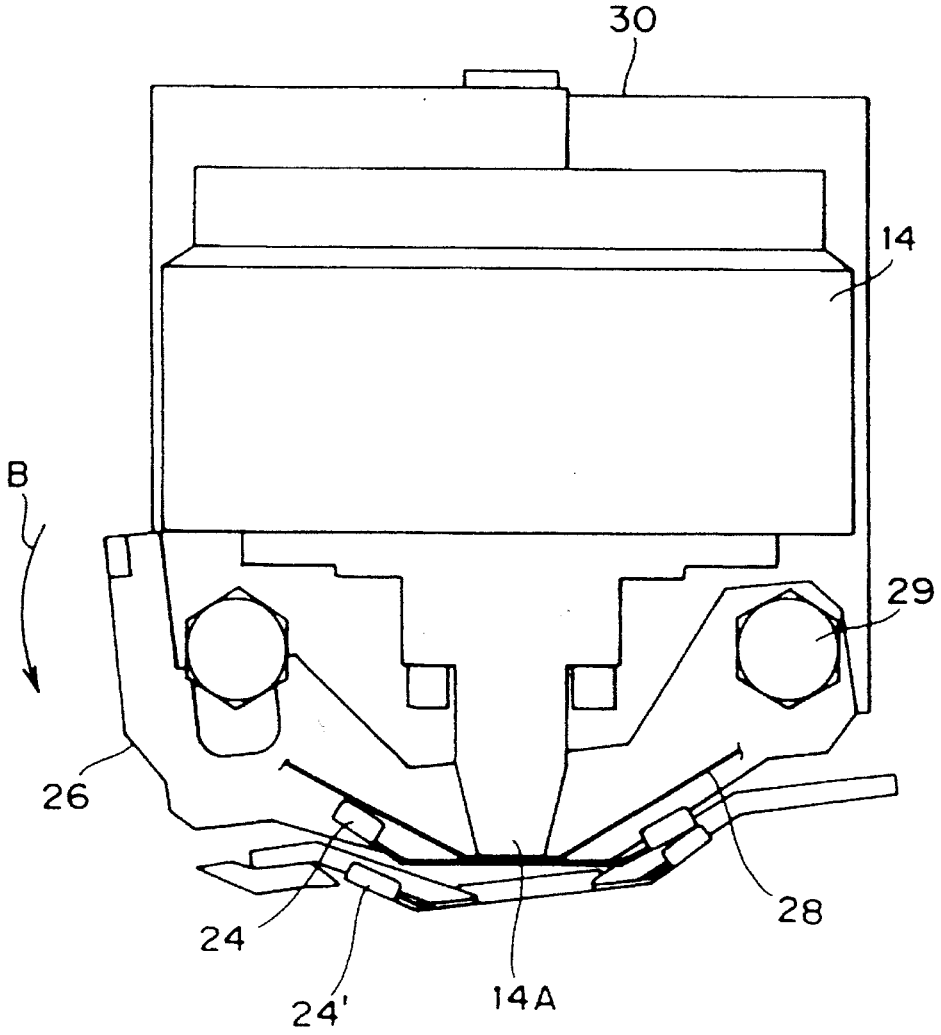
FIG. 4 PRIOR ART
FIG. 4 is an elevational view of a conventional ribbon mask opening mechanism.

A conventional ribbon mask opening mechanism will now be described with reference to FIG. 4. As shown in FIG. 4, the replacement of a printing ribbon 28 in a conventional bankbook printer is allowed by inclining a bracket 26 supporting a ribbon mask 24 about a pivot 29 to thereby form a gap between the printing portion 14A of the print head 14 and the ribbon mask 24. More specifically, reference numeral 24 denotes the ribbon mask set in a position where printing is performed, whereas reference numeral 24' denotes the ribbon mask set in another position where the bracket 26 is pressed down in a direction of arrow B in FIG. 4. The ribbon 28 is passed between the printing portion 14A and the ribbon mask 24. The ribbon mask 24 has an opening at a portion opposed to the printing portion 14A. In FIG. 4, reference numeral 30 denotes a carriage on which the print head 14 is mounted.

Figure 5:
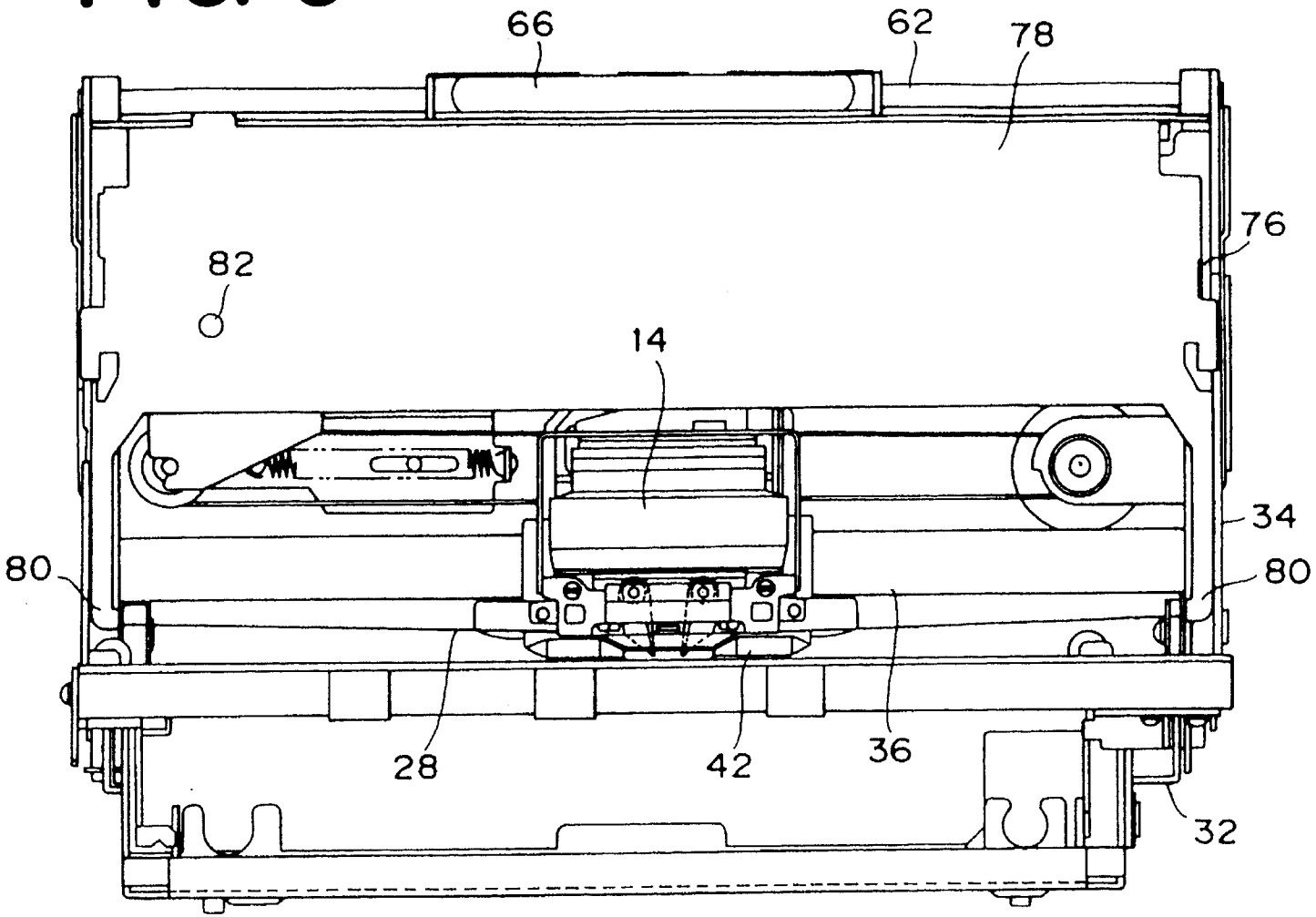
FIG. 5 is an elevational view showing a closed condition of a ribbon mask in a preferred embodiment of the present invention.
Figure 6:
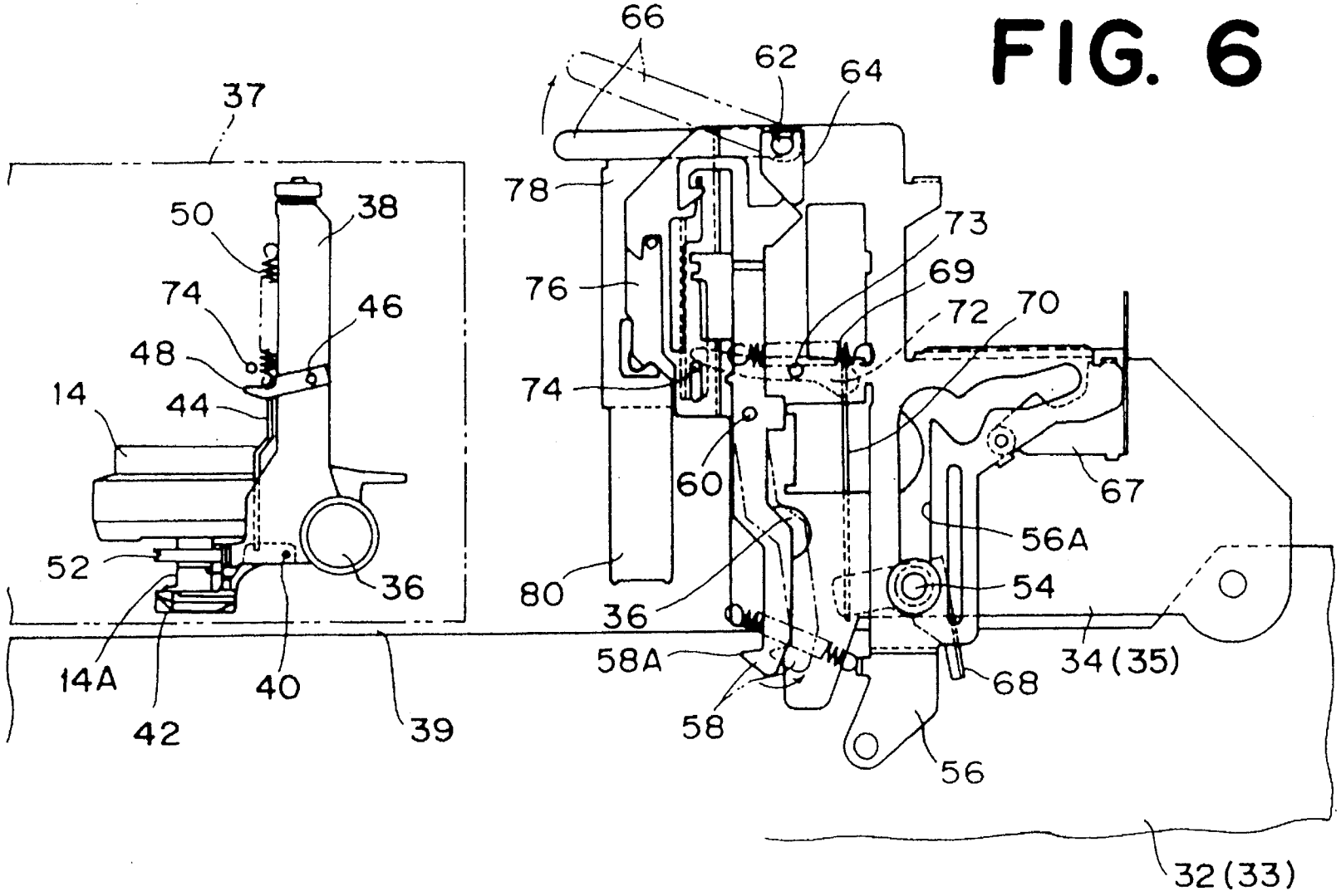
FIG. 6 is a side view showing the closed condition shown in FIG. 5.
Figure 7:
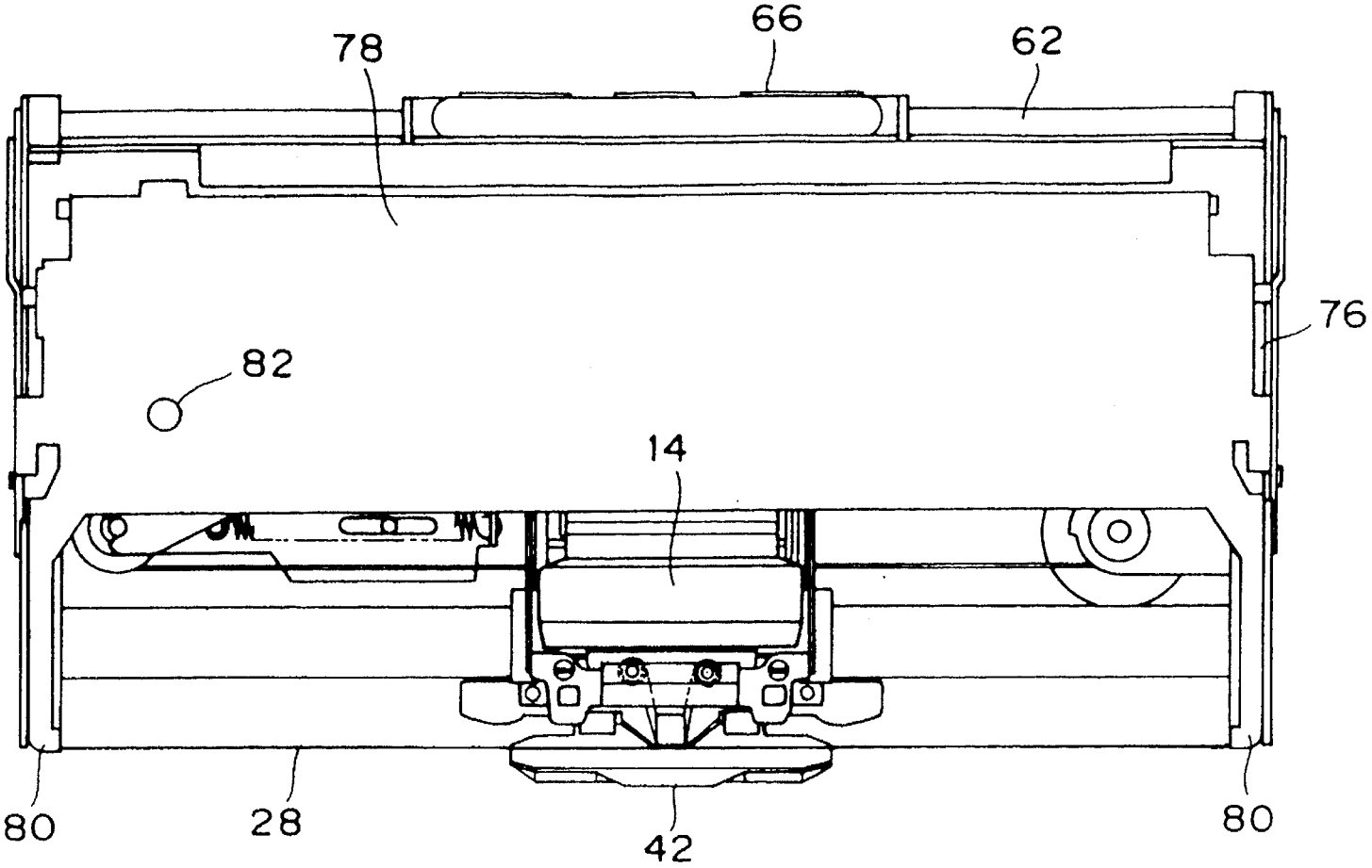
FIG. 7 is an elevational view showing an open condition of the ribbon mask in the preferred embodiment.
Figure 8:
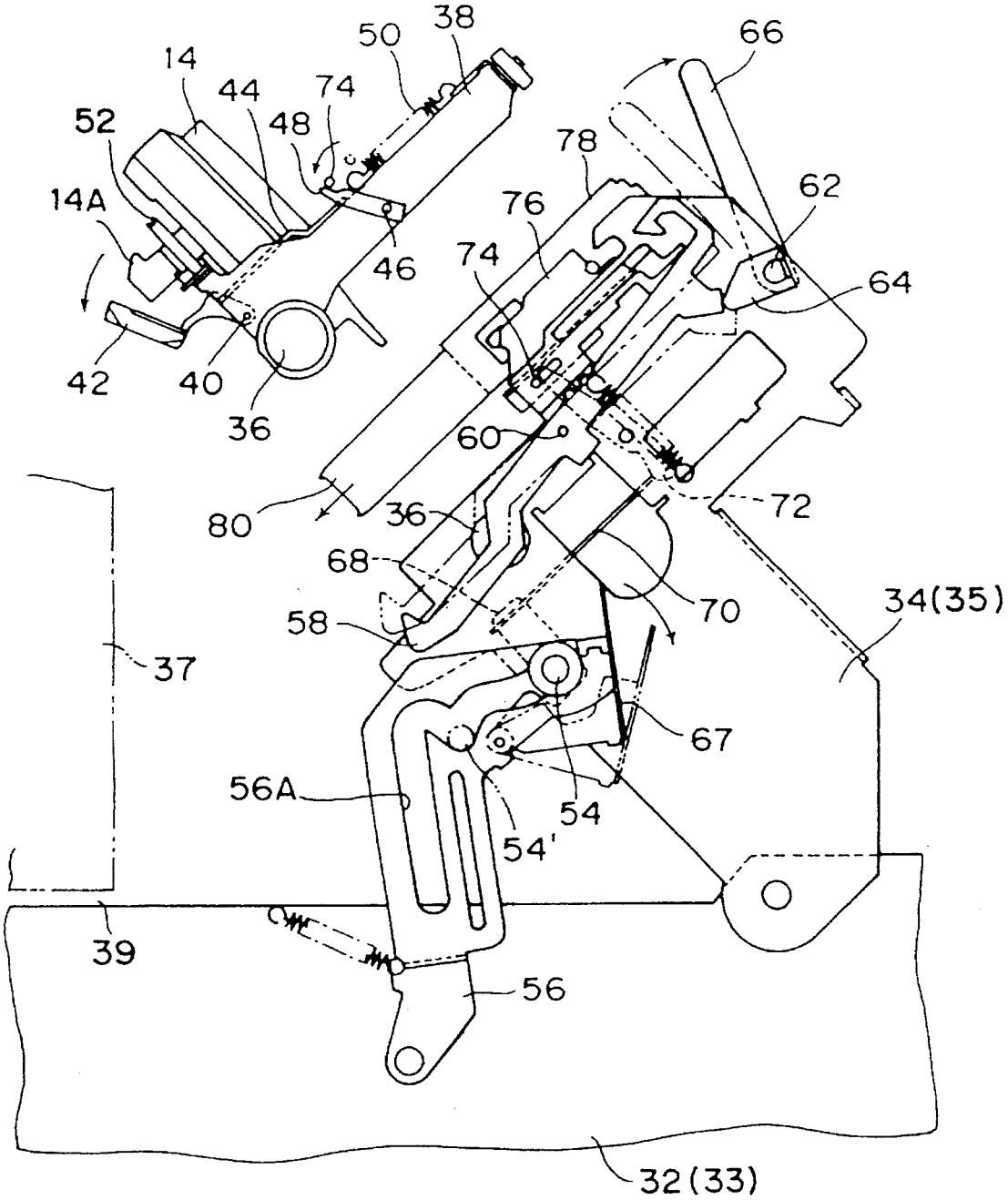
FIG. 8 is a side view showing the open condition shown in FIG. 7.

FIGS. 5 and 6 are an elevational view and a side view of a bankbook printer in this preferred embodiment, respectively, showing a closed condition of a ribbon mask, whereas FIGS. 7 and 8 are views similar to FIGS. 5 and 6, respectively, showing an open condition of the ribbon mask.

The bankbook printer in this preferred embodiment has a fixed frame 32, a movable frame 34 pivotably mounted to the fixed frame 32, and a laterally extending shaft 36 supported to the movable frame 34. A carriage 38 for mounting the print head 14 is slidably supported on the shaft 36. It should be noted that the carriage 38 is shown separately from the movable frame 34 in FIGS. 6 and 8 for the purpose of ensuring the clearness of the drawings.

The fixed frame 32 and its associated parts constitute a fixed unit 33, and the movable frame 34 and its associated parts constitute a movable unit 35. A front frame 37 is provided over the fixed unit 33 before the movable unit 35 in a direction of insertion of a recording medium so as to be openable from the fixed frame 32. A feed path 39 for the recording medium is formed between the front frame 37 and the fixed unit 33 and between the movable unit 35 and the fixed unit 33. Another shaft 40 parallel to the shaft 36 is provided in the carriage 38 at a position before the shaft 36 in the inserting direction of the recording medium, and a ribbon mask 42 is pivotably mounted on the shaft 40.

In printing, the ribbon mask 42 is set in a first position (see FIG. 6) where a slight gap is defined between the ribbon mask 42 and the printing portion 14A of the print head 14 to guide a printing ribbon 28 through this gap. On the other hand, in replacing the printing ribbon 28, the ribbon mask 42 is set in a second position (see FIG. 8) where an enough gap is defined between the ribbon mask 42 and the printing portion 14A of the print head 14. A link 44 is connected at its lower end to the ribbon mask 42. An upper end of the link 44 is connected to a lever 48 pivotably mounted on a shaft 46 provided in the carriage 38. A coil spring 50 for biasing the ribbon mask 42 from the second position to the first position is stretched between the upper end of the link 44 and the carriage 38. Accordingly, in printing, the ribbon mask 42 is biased by the coil spring 50 and is therefore positioned with an optimum spacing from the printing portion 14A.

Reference numeral 52 (see FIGS. 6 and 8 and FIGS. 9 and 10 to be hereinafter referred to) denotes an eccentric collar as an eccentric jig engaged with the carriage 38 by a screw. The eccentric collar 52 serves to finely adjust the slight gap between the printing portion 14A and the ribbon mask 42 set in the first position. A part of the ribbon mask 42 in the first position abuts against the eccentric collar 52 in receipt of a biasing force of the coil spring 50 to thereby decide the gap between the printing portion 14A and the ribbon mask 42. That is, in adjusting the gap between the printing portion 14A and the ribbon mask 42, the screw engaging the eccentric collar 52 with the carriage 38 is first loosened, and the eccentric collar 52 is then rotated about the screw, to a desired position. Since the distance from the screw to the outer circumference of the eccentric collar 52 varies with a rotational position of the eccentric collar 52, the gap between the printing portion 14A and the ribbon mask 42 can be decided by deciding a desired position of the outer circumference of the eccentric collar 52 against which the ribbon mask 42 abuts. Thus, the gap between the printing portion 14A and the ribbon mask 42 can be adjusted by a simple operation.

When the lever 48 is depressed, the link 44 connected to the lever 48 is pushed downward to thereby open downward the ribbon mask 42 connected to the link 44 about the shaft 40. In this condition, the printing ribbon 28 can be replaced very easily. When a depression force applied to the lever 48 is removed, the link 44 is pulled up by the biasing force of the coil spring 50 (i.e., its own contracting force), thereby upward closing the ribbon mask 42. A closed position of the ribbon mask 42 at this time is decided by the eccentric collar 52. In this closed condition, the contact between the ribbon mask 42 and the eccentric collar 52 is maintained by the biasing force of the coil spring 50, thus accurately forming the slight gap for guiding the printing ribbon 28 between the printing portion 14A and the ribbon mask 42.

This kind of bankbook printer employs means of allowing an opening/closing operation of the movable frame 34, so as to eliminate jamming or the like of a bankbook as a printing medium. Specifically, an upper portion of the fixed frame 32 forms a lower guide for the feed path 39, and a lower portion of the movable frame 34 forms an upper guide for the feed path 39. Thus, the feed path 39 is formed by the fixed frame 32 and the movable frame 34 to allow the bankbook to be fed in the feed path 39. Further, the front frame 37 is provided on the left side (as viewed in FIG. 6) of the movable frame 34, and the image sensor 22 and the like (see FIG. 3) are provided inside the front frame 37. A lower portion of the front frame 37 also forms an upper guide for the feed path 39. Accordingly, in case of jamming of the bankbook in the feed path 39, the feed path 39 can be opened by opening the movable frame 34, thus allowing the bankbook jammed to be removed. In this preferred embodiment, the ribbon mask 42 is designed to be automatically opened and closed in concert with the opening/closing operation of the movable frame 34. Such an automatic mechanism will be more specifically described below.

The movable frame 34 has a stud 54 projecting laterally therefrom. Reference numeral 56 denotes a hinge pivotably supported to the fixed frame 32. The hinge 56 has a guide portion 56A for guiding the stud 54. The guide portion 56A is formed by punching. The shape of the guide portion 56A is set so as to selectively define a first condition where the printer is operable, a second condition where the recording medium (bankbook) or the like jammed in the printer is removable, and a third condition where the printing ribbon is replaceable. In the first condition, the stud 54 has a position shown in FIG. 6 relative to the guide portion 56A of the hinge 56; in the second position, the stud 54 has a position shown by reference numeral 54' in FIG. 8; and in the third condition, the stud 54 has a position shown in FIG. 8.

A lock lever 58 is pivotably mounted on a shaft 60 fixedly supported to the movable frame 34, so as to lock the movable frame 34 in the first condition. A shaft 62 is rotatably supported to an upper portion of the movable frame 34, and a cam 64 and a handle 66 are fixed to each end and a central portion of the shaft 62, respectively. The lock lever 58 is biased by a coil spring 69 in such a manner that a lower end of the lock lever 58 is located at a left position as viewed in FIG. 6. In this condition, a pawl 58A formed at the lower end of the lock lever 58 is engaged with a pin (not shown) mounted on the fixed frame 32.

When the handle 66 is lift, the cam 64 interlockingly moves an upper end of the lock lever 58 to the left as viewed in FIG. 6, thereby canceling the locked condition of the movable frame 34 established by the lock lever 58. When a lifting force applied to the handle 66 is increased, the stud 54 is moved along the guide portion 56A of the hinge 56 to the position 54' shown in FIG. 8 to seat at this position. In this condition, the ribbon mask 42 remains closed as shown in FIG. 6; however, the movable frame 34 is opened to some extent. Accordingly, the feed path 39 is also opened to some extent, thereby allowing the recording medium (bankbook) jammed in the printer to be easily removed. This second condition can be shifted to the third condition allowing the replacement of the printing ribbon by further increasing the lifting force applied to the handle 66. When the handle 66 is thus further lifted, the stud 54 is moved from the position 54' to the position 54 shown in FIG. 8. To maintain this third condition, a locking/unlocking member 67 is pivotably supported to the hinge 56.

The operation of shifting from the second condition to the third condition will now be more specifically described. When the lifting force is applied to the handle 66 in the second condition, a projection of the hinge 56 comes into contact with a cam 68, and a link 70 connected to the cam 69 upward pushes a right end of a lever 72. The lever 72 is pivotably mounted on a shaft 73 fixedly supported to the movable frame 34. When the right end of the lever 72 is raised by the link 70, the left end of the lever 72 is lowered to thereby lower a shaft 74. The shaft 74 is integral with a ribbon frame 76 which is vertically movable relative to the movable frame 34, and the lowering motion of the shaft 74 causes interlocking downward movement of the lever 48 in the carriage 38. In this manner, the shifting from the second condition to the third condition causes the lowering of the lever 48, thus automatically opening the ribbon mask 42 (see FIG. 8). When the locking/unlocking member 67 is rotated clockwise as viewed in FIG. 8, the stud 54 is moved to the position 54' by the own weights of the movable frame 34 and its associated parts, thus obtaining the second condition. Accordingly, the ribbon mask 42 is automatically closed in the order reverse to that of the above operation.

In this preferred embodiment, the shifting from the second condition to the third condition causes downward movement of the ribbon frame 76 relative to the movable frame 34. The reason for this movement will now be described. As shown in FIGS. 5 and 7, the printing ribbon 28 is stored in the form of roll in a ribbon cassette 78. The ribbon cassette 78 has a pair of ribbon arms 80 projecting downward from the right and left open ends as viewed in front elevation. A part of the printing ribbon 28 stored in the ribbon cassette 78 is stretched between the right and left open ends of the two ribbon arms 80. Reference numeral 82 denotes a manual winding knob for preventing slack of the printing ribbon 28 stretched between the ribbon arms 80.

The ribbon cassette 78 is set on the ribbon frame 76 vertically movable relative to the movable frame 34. In the first or second condition, the ribbon mask 42 is kept closed. In this condition, the ribbon frame 76 has an upper position relative to the movable frame 34, and the lower ends of the ribbon arms 80 are positioned slightly above the printing portion 14A of the print head 14. Accordingly, no undesired load is applied to the printing ribbon 28 stretched between the ribbon arms 80 during the printing operation. On the other hand, in the third condition where the ribbon mask 42 is open, the ribbon frame 76 has a lower position relative to the movable frame 34, and the lower ends of the ribbon arms 80 are positioned below the printing portion 14A of the print head 14. In this condition, the ribbon 28 stretched between the ribbon arms 80 becomes substantially straight, so that the ribbon cassette 78 can be easily replaced. Such vertical movement of the ribbon frame 76 is based on the vertical movement of the shaft 74 operated by the lever 72 (see FIGS. 6 and 8). The lever 72 operates so as to press down the shaft 74, and the ribbon frame 76 is normally biased upward by a biasing means not shown.

While the coil spring 50 is used to bias the ribbon mask 42 in its closing direction in the above preferred embodiment, the coil spring 50 may be omitted by using a ribbon mask formed from an elastic body and fixing the elastic ribbon mask to the shaft 40, thereby allowing a cost reduction of the device. In this case, the elastic ribbon mask is normally biased in its closing direction by its own elastic restoring force. Further, while the shaft 40 independent of the shaft 36 is provided to pivotably support the ribbon mask 42 to the carriage 38 in the above preferred embodiment, the two shafts 40 and 36 may be used as a common shaft to reduce the number of parts, thereby contributing to a cost reduction. A specific embodiment of this idea will now be described with reference to FIGS. 9 and 10.

Figure 9:
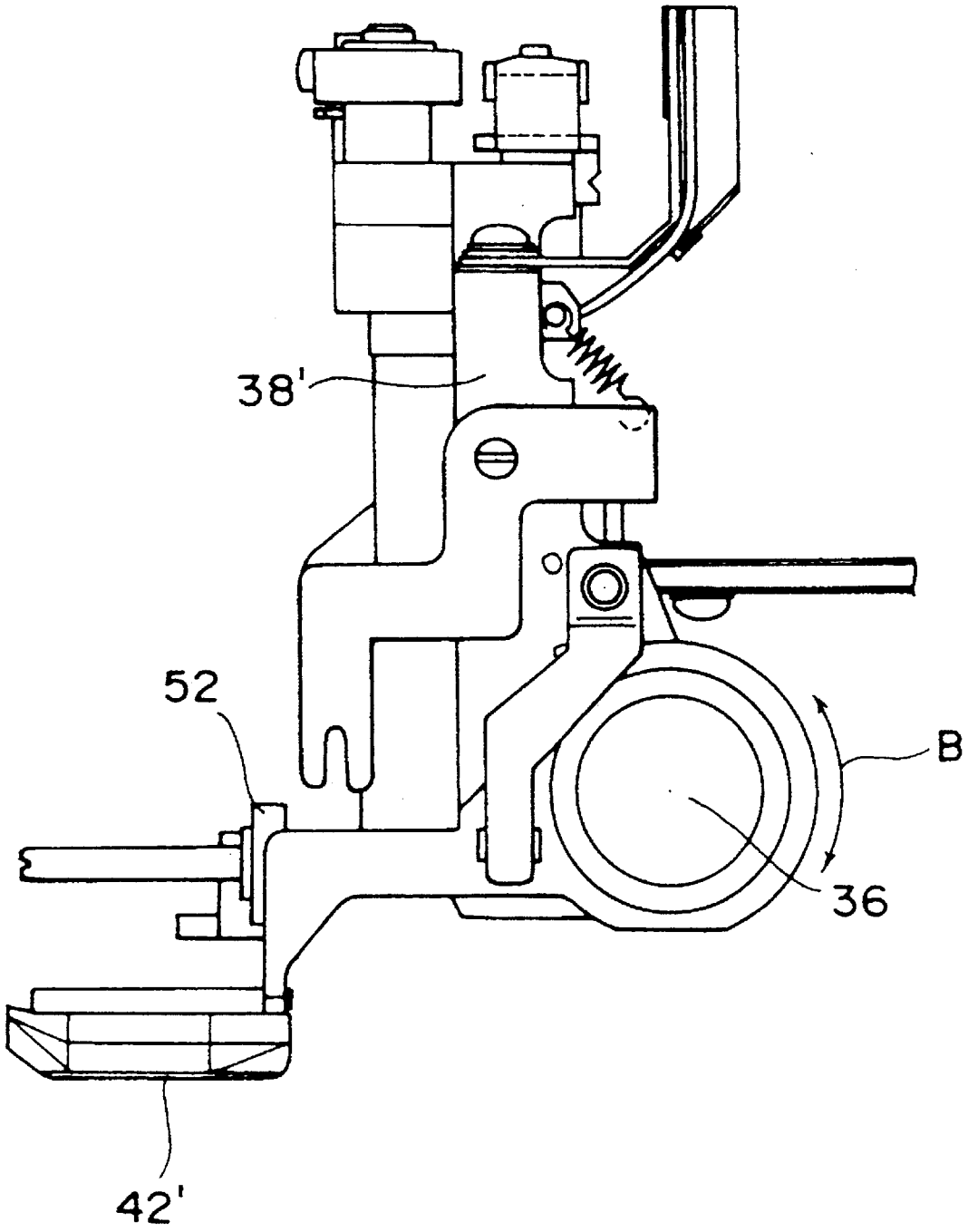
FIG. 9 is a side view of a carriage showing another preferred embodiment of the present invention.
Figure 10:
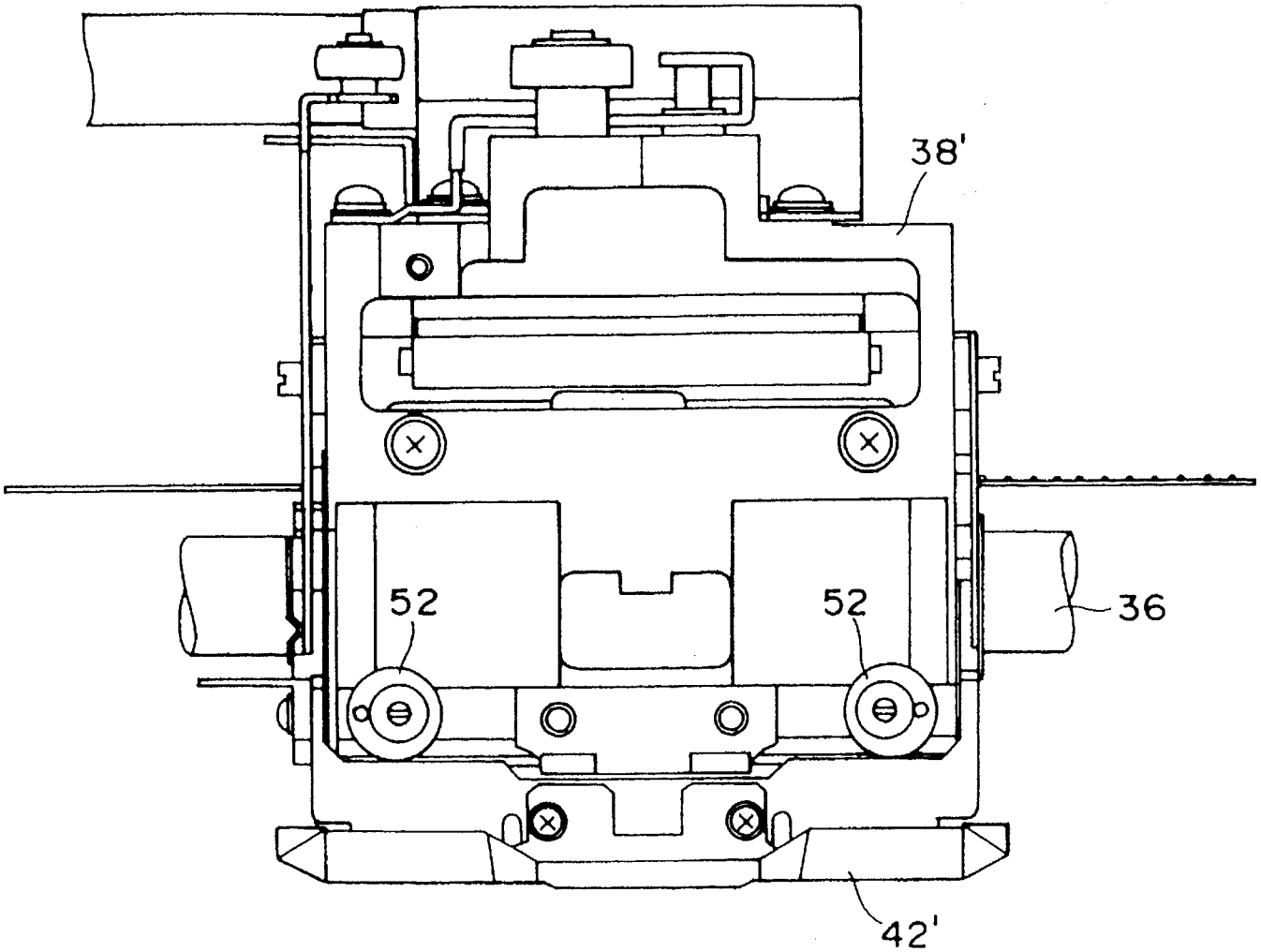
FIG. 10 is an elevational view of the carriage shown in FIG. 9.

FIG. 9 is a side view of a carriage according to another preferred embodiment of the present invention, and FIG. 10 is an elevational view of the carriage shown in FIG. 9. In this preferred embodiment, a ribbon mask 42' is pivotably mounted on a shaft 36 for horizontally movably supporting a carriage 38'. Accordingly, the ribbon mask 42' is pivoted about the shaft 36 in a direction of arrow B in FIG. 9. Reference numeral 52 denotes an eccentric collar similar to that in the previous preferred embodiment, for positioning the ribbon mask 42' in its closed condition. The eccentric collar 52 serves to finely adjust the position of the ribbon mask 42' by using the eccentricity of a flange portion of the eccentric collar 52. As similarly to the previous preferred embodiment, the ribbon mask 42' is pivotally moved in association with the opening/closing operation of the movable frame. According to this preferred embodiment, any shaft independent of the shaft 36 as in the previous preferred embodiment for pivotably supporting the ribbon mask 42' to the carriage 38' is unnecessary because the ribbon mask 42' is pivotably mounted on the shaft 36. Accordingly, this preferred embodiment greatly contributes to simplification of the device structure.

According to the above-mentioned preferred embodiments of the present invention, it is possible to provide a ribbon mask opening mechanism for a printer which allows an operator to smoothly carry out the replacement of the ribbon and also allows the operator to easily set the ribbon in a proper position.

The following embodiment relates to a deflector mechanism for preventing the jamming of a deformed recording medium.

Figure 11:
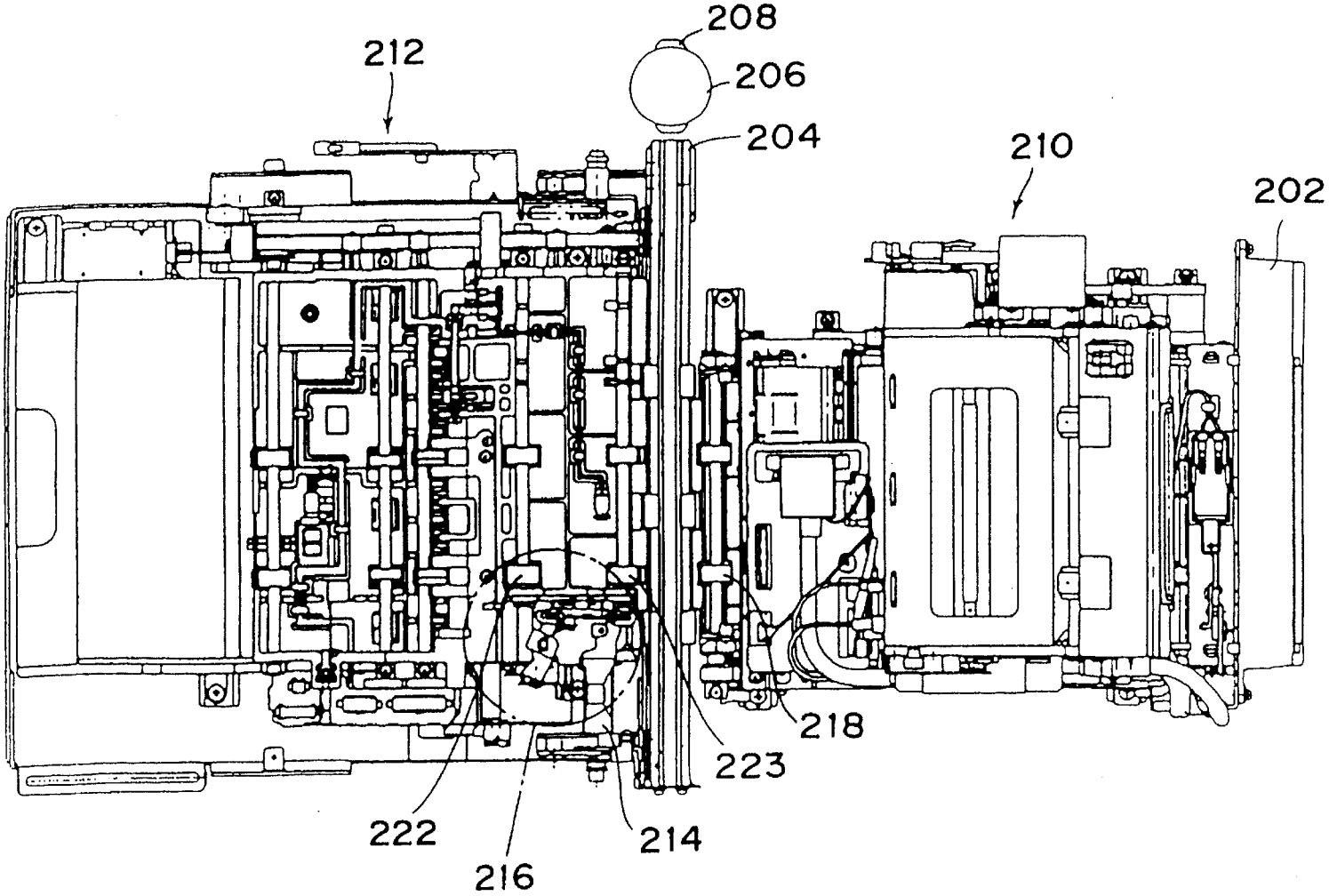
FIG. 11 is a plan view of a bankbook printer showing a further preferred embodiment of the present invention.

FIG. 11 is a plan view of a bankbook printer according to another preferred embodiment of the present invention. The printer shown in FIG. 11 has a bankbook inlet 202 for insertion of a bankbook as a recording medium and a platen 204. The platen 204 cooperates with a print head 206 to constitute a printing section. The print head 206 is provided in a printer unit (not shown in FIG. 11) to be hereinafter described. Reference numeral 208 denotes a ribbon mask for guiding a printing ribbon to a printing portion formed at a lower end of the print head 206. Reference numeral 210 denotes a front inserter unit provided on the front side of the printing section for feeding the recording medium inserted from the bankbook inlet 202 to the printing section, and reference numeral 212 denotes a rear feed unit provided on the rear side of the printing section for feeding the recording medium fed through the front inserter unit 210. The rear feed unit 212 is provided with a deflector mechanism 216 including a deflector 214. Reference numeral 218 denotes a feed roller provided in the front inserter unit 210, and reference numeral 222 and 223 denote a feed roller provided in the rear feed unit 212.

Figure 12:
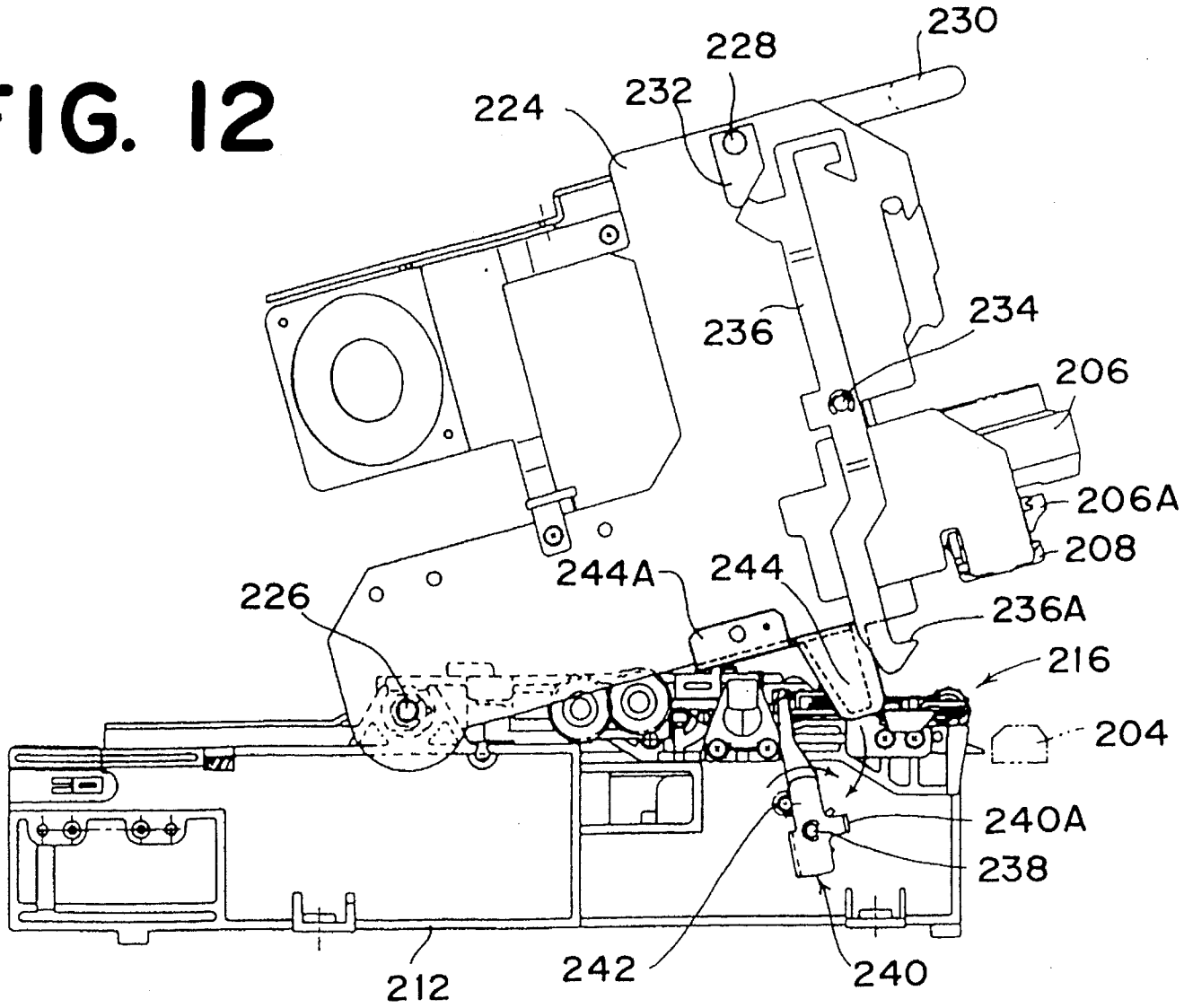
FIG. 12 is a side view of an essential part of the bankbook printer shown in FIG. 11 in an open condition of a printer unit.
Figure 13:
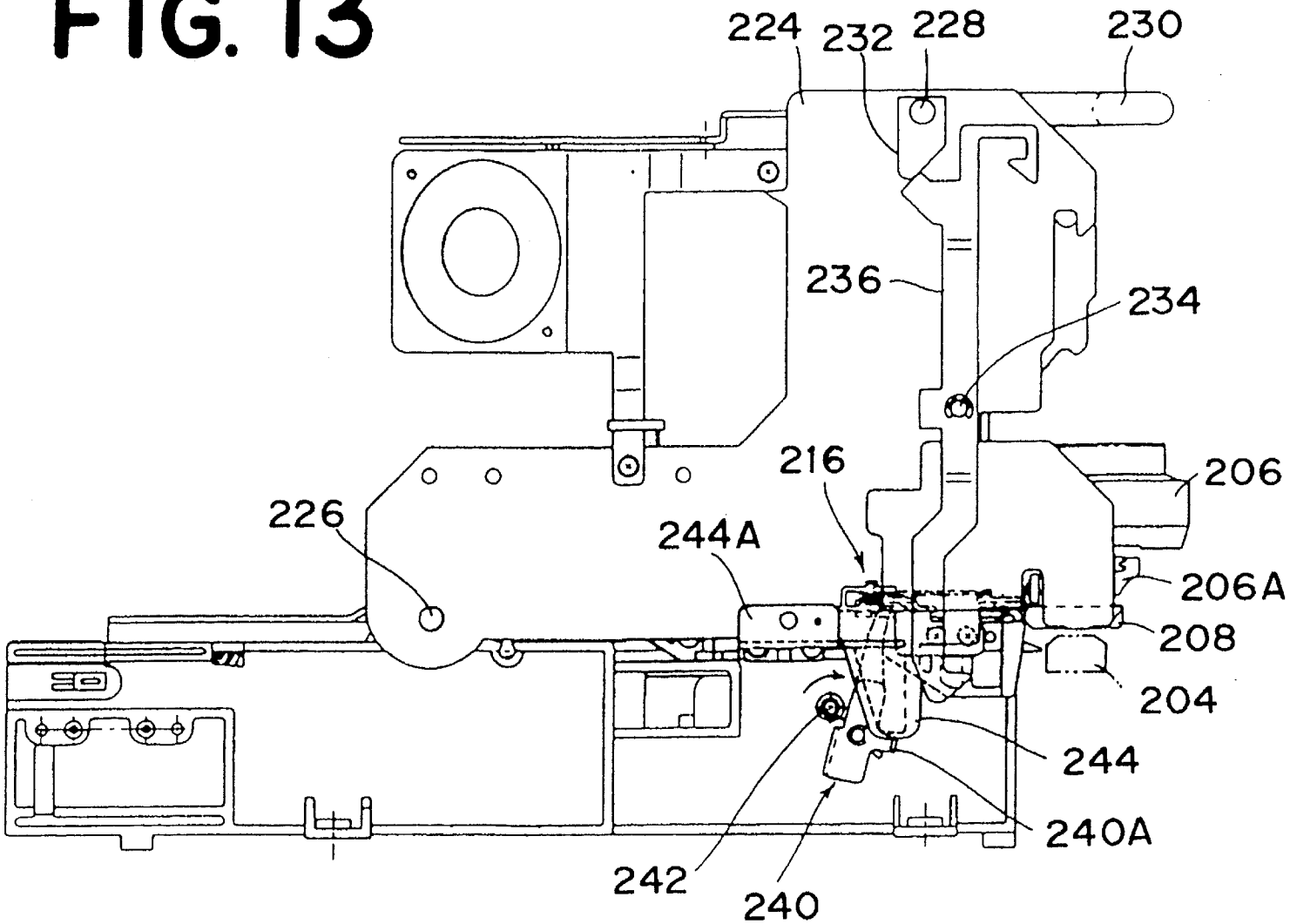
FIG. 13 is a view similar to FIG. 12, showing a closed condition of the printer unit.

FIGS. 12 and 13 are side views of an essential part of the bankbook printer shown in FIG. 11 in an open condition and a closed condition of the printer unit, respectively. The printer unit denoted by reference numeral 224 is pivotably mounted on a shaft 226 provided in the rear feed unit 212 to thereby allow an opening/closing operation of the printer unit 224 with respect to the rear feed unit 212. A shaft 228 is rotatably provided at an upper portion of the printer unit 224, and a handle 230 and a cam 232 are fixed to the shaft 228. A lever 236 for locking the printer unit 224 in its closed condition is pivotably mounted on a shaft 234 projecting sideward from the printer unit 224. When the printer unit 224 is closed, a pawl 236A formed at a lower end of the lever 236 is engaged with a pin (not shown) provided in the rear feed unit 212, thereby locking the printer unit 224. In canceling the locked condition of the printer unit 224, the handle 230 is lifted to move an upper end of the lever 236 rightward as viewed in FIG. 13 through the cam 232. Accordingly, the engagement of the pawl 236A is canceled to allow the printer unit 224 to be opened.

The deflector mechanism 216 further includes a lever 240 pivotably mounted on a shaft 238 provided in the rear feed unit 212 and a plate 244 mounted through its mounting portion 244A to the printer unit 224. The lever 240 is biased counterclockwise as viewed in FIG. 12 by a torsion spring 242. The lever 240 has a projection 240A in the vicinity of the shaft 238. In the closing operation of the printer unit 224, the projection 240A is pressed down by a lower end of the plate 244 to pivot the lever 240 clockwise as viewed in FIG. 12 against a biasing force of the torsion spring 242. The reason why the torsion spring 242 is used to bias the lever 240 is to ensure a stable position of the lever 240 in the open condition of the printer unit 224.

Figure 14:
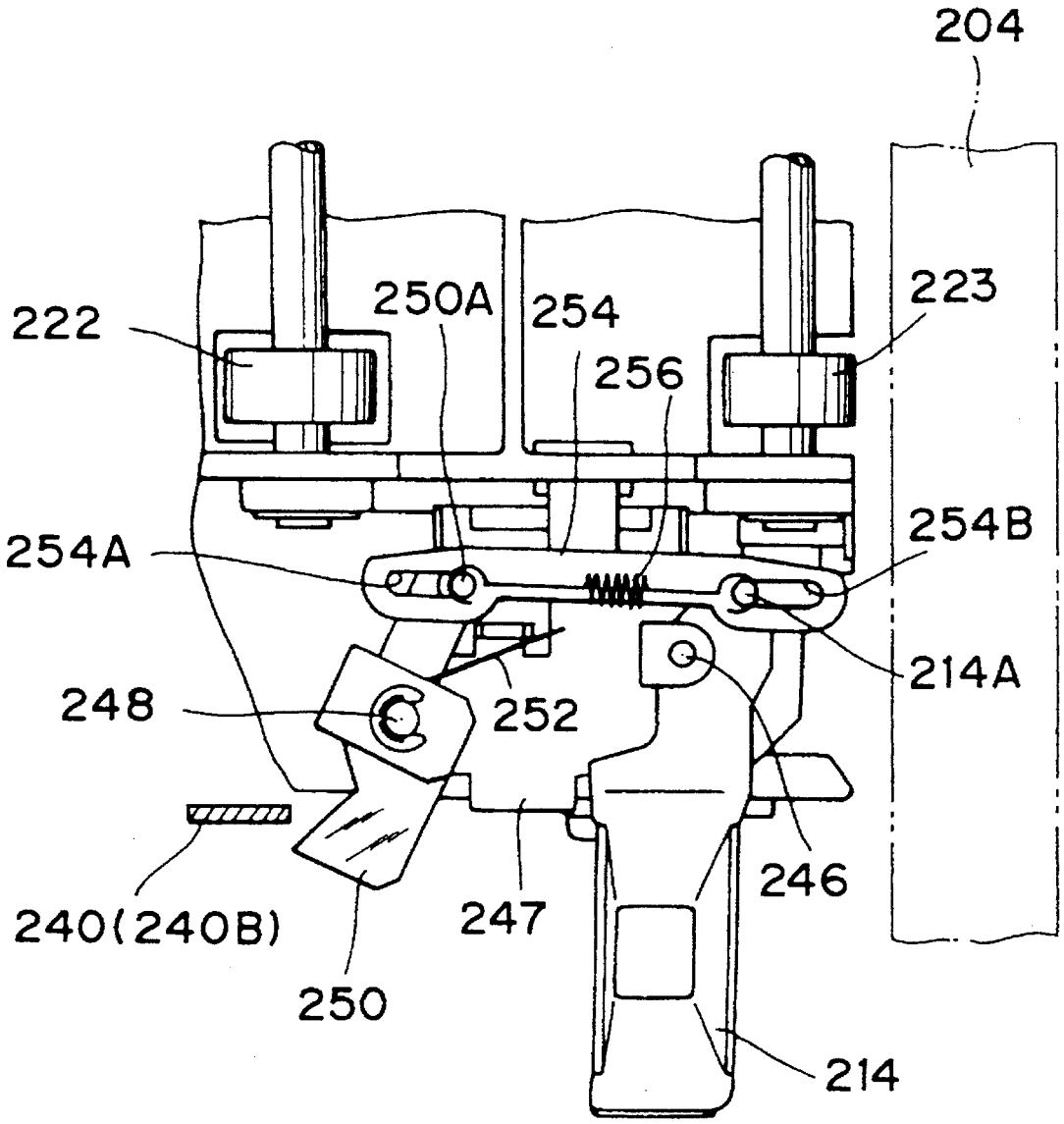
FIG. 14 is a plan view of a deflector mechanism in the open condition of the printer unit.
Figure 15:
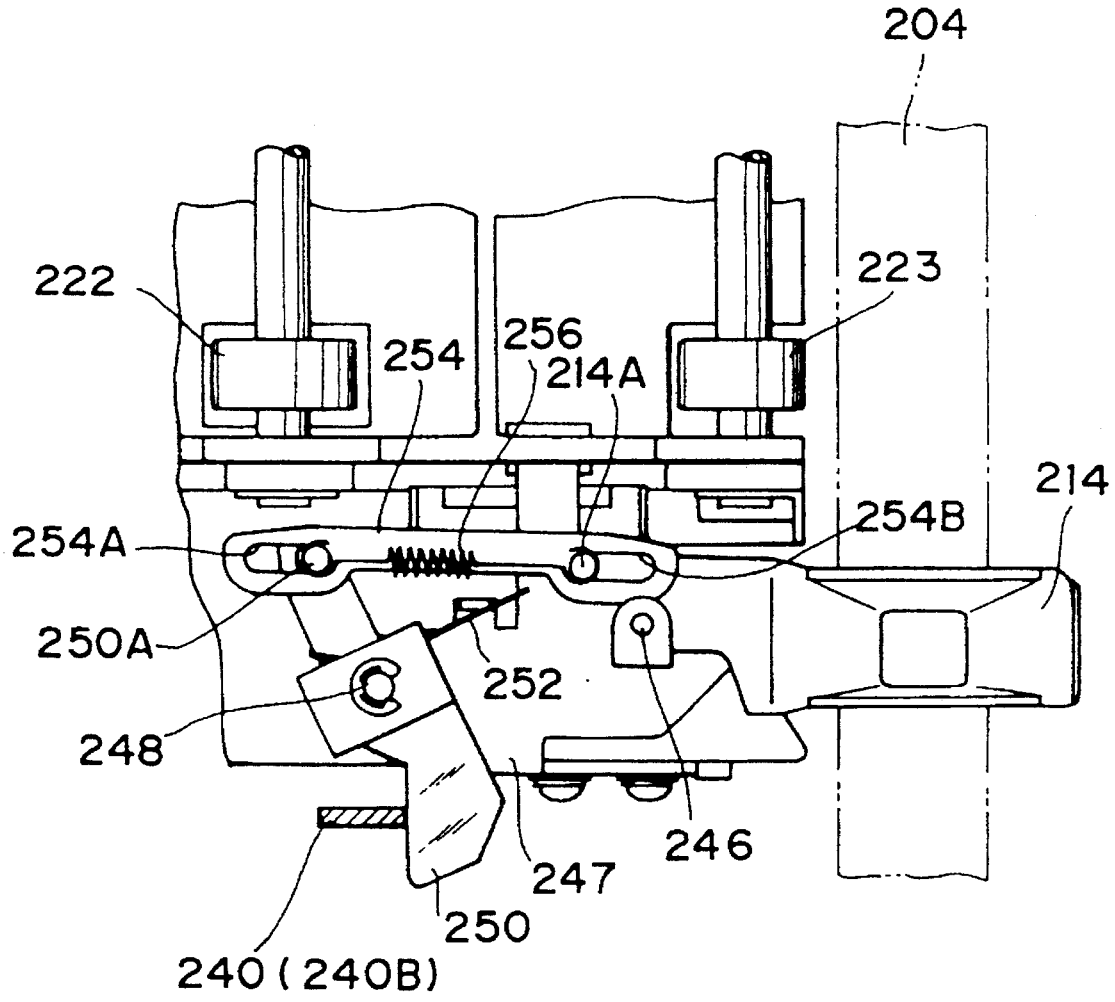
FIG. 15 is a plan view of the deflector mechanism in the closed condition of the printer unit.

FIGS. 14 and 15 are plan views of the deflector mechanism 216 in the open condition and the closed condition of the printer unit 224, respectively. The deflector 214 is pivotably mounted on a shaft 246 provided on a frame 247 of the rear feed unit 212. To drive the deflector 214 in association with the opening/closing operation of the printer unit 224 in this preferred embodiment, there are provided a plate 250 pivotably mounted on a shaft 248 parallel to the pivotal shaft 246 for the deflector 214 and a link 254 having elongated holes 254A and 254B loosely engaging with projections 214A and 250A provided at end portions of the deflector 214 and the plate 250, respectively. A torsion spring 252 is provided to bias the plate 250 clockwise as viewed in FIG. 14. Further, a coil spring 256 is stretched between the two projections 250A and 214A to bias them in its contracting direction. The coil spring 256 may be replaced by an elastic body such as rubber stretched between the two projections 250A and 214A.

When the printer unit 224 is in the open condition with respect to the rear feed unit 212, the plate 244 does not operate the lever 240 (see FIG. 12). Accordingly, the lever 240 is kept in its stable position by a biasing force of the torsion spring 242, and a front end of the lever 240 is out of contact with the plate 250 (see FIG. 14). In this condition, the plate 250 receives an enough biasing force in the clockwise direction as viewed in FIG. 14 from the torsion spring 252. This enough biasing force acts so as to urge the projection 214A of the deflector 214 through the link 254 rightward as viewed in FIG. 14. As a result, the deflector 214 is oriented in substantially parallel to the platen 204. Such a parallel position (second position) of the deflector 214 is offset from the platen 204 to the rear feed unit 212. Accordingly, the deflector 214 in its second position does not hinder the movement of the print head 206 (see FIG. 13) along the platen 204. That is, the deflector 214 is pivoted to the second position outside of a movable range of the print head 206.

When the printer unit 224 is closed with respect to the rear feed unit 212 as shown in FIG. 13, the lower end of the plate 244 pushes down the projection 240A of the lever 240 to thereby pivot the lever 240 clockwise as viewed in FIG. 13. As a result, the front end 240B of the lever 240 pushes to pivot the plate 250 counterclockwise as viewed in FIG. 15 against the biasing force of the torsion spring 252 and thereby move the projection 250A of the plate 250 leftward as viewed in FIG. 15. Since the coil spring 256 is stretched between the projection 250A of the plate 250 and the projection 214A of the deflector 214, the leftward displacement of the projection 250A of the plate 250 accompanies the leftward displacement of the projection 214A of the deflector 214, thereby pivoting the deflector 214 counterclockwise as viewed in FIG. 15. In this condition, the deflector 214 overlaps an end portion of the movable range of the print head 206 at a position (first position) just over the platen 204. Accordingly, when the printer unit 224 is closed and the recording medium is then fed to the printing section, the recording medium is smoothly fed between the platen 204 and the deflector 214, thus preventing the jamming of the recording medium between the front inserter unit 210 and the platen 204 or between the platen 204 and the rear feed unit 212.

In this preferred embodiment, the link 254 has the elongated holes 254A and 254B, and the coil spring 256 is stretched between the projections 250A and 214A respectively loosely engaged with the elongated holes 254A and 254B. Accordingly, the deflector 214 can be retracted from the first position to the second position by a force against the biasing force of the coil spring 256. That is, even when the print head 206 comes into contact with the deflector 214 set in the first position after starting the printing operation, the deflector 214 does not hinder the operation of the print head 206.

As described above, this preferred embodiment employs biasing means (coil spring 256) for biasing the deflector 214 in the first position from the second position to the first position. Accordingly, it is unnecessary to retract the deflector 214 to the second position in performing the printing operation. Furthermore, when the printer unit 224 is in the open condition, the deflector 214 is always retracted to the second position. Accordingly, the maintenance of the particulars in the printer can be easily performed in the open condition of the printer unit 224.

Further, the plate 244 and the lever 240 can be easily set in their shapes and relative positional relationship so that the deflector 214 is moved from the second position to the first position just before the printer unit 224 is fully closed. Accordingly, even when the print head 206 is located at a position corresponding to the first position of the deflector 214 upon closing the printer unit 224, there is no possibility that the print head 206 or the ribbon mask 208 located just under the print head 206 may come into contact with the deflector 214 to damage the deflector 214 and its driving mechanism.

According to this preferred embodiment of the present invention, it is possible to provide a printer having a deflector mechanism which is simple in structure and fit for a reduction in cost.

Having thus described specific embodiments of the present invention, it should be understood that the preferred embodiments are merely illustrative and not limitative. It is to be noted that the scope of the invention is set out in the appended claims, and all changes and modifications that fall within equivalence of the claims are intended to be embraced by the claims.

What is claimed is:

1. A printer comprising:

a fixed frame; and a movable frame pivotably mounted on said fixed frame, said movable frame including a carriage slidably supported to a first shaft and adapted to reciprocate along said first shaft;

a print head mounted on said carriage and having a printing portion;

ribbon guiding means for guiding a printing ribbon so that said printing ribbon is slidably held between said ribbon guiding means and said printing portion, said ribbon guiding means having a first position where a first gap is defined between said ribbon guiding means and said printing portion to guide said printing ribbon during printing and a second position where a second gap is defined between said ribbon guiding means and said printing portion during replacing said printing ribbon wherein said second gap is larger than the first gap;

biasing means for biasing said ribbon guiding means from said second position to said first position;

a link having a first end and a second end, said first end being connected to said ribbon guiding means; and a lever connected to said second end of said link for displacing said ribbon guiding means from said first position to said second position against a biasing force of said biasing means, wherein said ribbon guiding means is displaced between said first and second positions when said movable frame pivoted.

2. A printer according to claim 1, wherein said biasing means comprises a coil spring stretched between said second end of said link and said carriage.

3. A printer according to claim 1, wherein said ribbon guiding means is pivotable about an axis of a shaft parallel to a feeding direction of said printing ribbon.

4. A printer according to claim 3, wherein said ribbon guiding means comprises an elastic body, said ribbon guiding means being fixed to said shaft, said ribbon guiding means including said biasing means.

5. A printer according to claim 3, wherein said shaft comprises a second shaft provided on said carriage.

6. A printer according to claim 3, wherein said shaft and said first shaft are formed as a common shaft.

7. A printer according to claim 1, further comprising:

said first shaft is horizontally supported on said movable frame;

a stud projecting sideward from said movable frame;

a hinge pivotably supported to said fixed frame and having a guide portion for guiding said stud, said guide portion having a shape allowing said movable frame to be selectively positioned to a first condition where said printer is operable, a second condition where a recording medium jammed in said printer is removable, and a third condition where said printing ribbon is replaceable; and means interlocked with said hinge to operate said lever only in said third condition.

8. A printer according to claim 7, further comprising:

means for locking said movable frame in said first condition; and means for canceling a locked condition of said movable frame established by said locking means.

9. A printer according to claim 7, further comprising:

a ribbon cassette for storing said printing ribbon; and means interlocked with said ribbon guiding means to vertically move said ribbon cassette.

10. A printer comprising:

a fixed unit;

a movable unit pivotably supported on said fixed unit and forming a feed path of a recording medium in opposed relationship to said fixed unit, said movable unit comprising a print head having a printing portion and ribbon guiding means for guiding a printing ribbon so that said printing ribbon is slidably held between said ribbon guiding means and said printing portion, said ribbon guiding means having a first position where a first gap is defined between said ribbon guiding means and said printing portion to guide said printing ribbon during printing and a second position where a second gap is defined between said ribbon guiding means and said printing portion during replacing said printing ribbon, said second gap being larger than said first gap; and linking means for changing said ribbon guiding means between said first position and said second position interlockingly upon pivotal movement of said movable unit.

11. A printer according to claim 10, wherein when said movable unit is opened with respect to said fixed unit to open said feed path, said second position of said ribbon guiding means is set by said linking means, whereas when said movable unit is closed with respect to said fixed unit, said first position of said ribbon guiding means is set by said linking means.

12. A printer according to claim 10, wherein said linking means allows said movable unit to be selectively positioned to a first condition where said printer is operable, a second condition where said recording medium jammed in said printer is removable, and a third condition where said printing ribbon is replaceable; and when said movable unit is in said first condition or said second condition, said first position of said ribbon guiding means is set by said linking means, whereas when said movable unit is in said third condition, said second position of said ribbon guiding means is set by said linking means.

13. A printer according to claim 10, further comprising:

a ribbon cassette for storing said printing ribbon; and means interlocked with said ribbon guiding means to vertically move said ribbon cassette.

14. A printer according to claim 13, wherein said ribbon cassette has a ribbon outlet from which said printing ribbon is supplied and a ribbon inlet from which said printing ribbon is restored; and when said movable unit is in said third condition, said ribbon cassette is positioned so that said printing ribbon becomes substantially straight between said ribbon outlet and said ribbon inlet.

* * * * *